US005988499A

United States Patent [19]

Sisca

[11] Patent Number: 5,988,499

[45] Date of Patent: Nov. 23, 1999

[54] NUMBER FREQUENCY COUNTER

[75] Inventor: Frank J. Sisca, 15 Buttercup La., San Carlos, Calif. 94070

[73] Assignee: Frank J. Sisca, San Carlos, Calif.

[21] Appl. No.: 08/904,336

[22] Filed: Jul. 31, 1997

[51] Int. Cl.[6] ..... G06C 15/00

[52] U.S. Cl. ..... 235/419; 273/309

[58] Field of Search ..... 235/419, 880, 235/425, 420; 273/309, 236, 269, 268, 276, 287, 288

[56] References Cited

U.S. PATENT DOCUMENTS

| | | | |
|---|---|---|---|
| 3,118,677 | 1/1964 | Lang | 237/144 |
| 3,876,209 | 4/1975 | Militello . | |
| 4,095,785 | 6/1978 | Conner | 273/1 GC |
| 4,121,830 | 10/1978 | Buckley | 273/237 |
| 4,151,404 | 4/1979 | Harrington et al. | 237/138 A |
| 4,312,511 | 1/1982 | Jullien | 273/138 A |
| 4,332,389 | 6/1982 | Loyd, Jr. et al. . | |
| 4,436,308 | 3/1984 | Rose et al. . | |
| 4,575,804 | 3/1986 | Ratcliff . | |
| 4,651,995 | 3/1987 | Henkel . | |
| 4,661,906 | 4/1987 | DiFrancesco et al. . | |

*Primary Examiner*—Thien Minh Le

*Attorney, Agent, or Firm*—Arnold, White & Durkee

[57] ABSTRACT

A number frequency counter for games such as bingo, keno, and lotto, which comprises a housing, a display, numerical calculator electrical operation circuit with a memory add circuit and storage registers, a plurality of number buttons that correspond to game numbers, a plurality of display lights corresponding to the number buttons, storage buttons, recall buttons, and buttons for clearing a storage register, a game of number buttons pushed, or an individual number button that was pushed. When a number button is pushed a value of one is stored in the memory add circuit and associated with that number button. Also the corresponding display light is illuminated. A series of pushed number buttons or game of pushed number buttons can be added to a storage register which adds the values associated with each number button to the previously stored values for every number button pushed. Multiple storage buttons can be included to store different games in different storage registers. Every time the storage button is pushed, the storage register adds values and thereby keeps a count of the number of times a number button has been pushed. The recall buttons can be pressed to display the values in a storage register and a clear button can be pressed to reset the values in a storage register to zero. Finally, clear buttons can reset the value associated with one number button to zero and to reset all of the values associated with the number buttons to zero.

13 Claims, 1 Drawing Sheet

NUMBER FREQUENCY COUNTER

FIELD OF THE INVENTION

This invention relates to a number frequency counting device. More particularly, this invention relates to a new portable frequency counting device for recording and storing of numbers called in multiple same games or different games at multiple locations such as bingo, keno and lotto and for calculating and displaying the frequency of the called numbers.

BACKGROUND OF THE INVENTION

As is well-known, in games such as bingo, keno and lotto, a series of numbers are required to obtain a winning game. For instance, in bingo, a player has a card containing a 5 by 5 matrix of squares containing numbers from one to eighty. Numbers are called, and if the bingo player has the numbers displayed on his or her card in a particular pattern, then the bingo player has won. Many bingo players would like to record how often each of the possible bingo numbers has been called to develop and confirm strategy.

Prior art bingo devices, such as those disclosed in U.S. Pat. No. 4,332,389 to Loyd, Jr. et al., U.S. Pat. No. 4,651,995 to Henkel, U.S. Pat. No. 4,661,906 to DiFrancesco et al., and U.S. Pat. No. 3,876,209 to Militello disclose various ways to record what numbers were called during a particular bingo game. Loyd, Jr. discloses an electronic bingo game that stores all the numbers called in a first bingo game during a second bingo game and until a third bingo game is initiated in order to verify late bingo win claims. Loyd does not, however, store numbers for repeated games and then calculate the frequency with which each was called.

Henkel and DiFrancesco disclose portable electronic bingo cards. Henkel discloses an electronic bingo card where the player can create the matrix of numbers on the card and then input the numbers as they are called. The electronic bingo card indicates with lights which numbers have been entered as called, which numbers are needed to achieve bingo, and all of the winning combinations when a win is achieved. DiFrancesco discloses an electronic bingo card for selecting numbers for several bingo cards and for assisting in playing and monitoring several bingo cards simultaneously. Neither Henkel nor DiFrancesco, however, allow for storing repeated games and calculating the frequency of the numbers called.

Militello discloses a mechanical device for recording what numbers were called during a bingo game wherein gamecounters are deposited in holes corresponding to a bingo number. Militello, however, lacks any electronic means and records what numbers have been called for only one game. It also lacks any means for automatically calculating how often a number has been called.

SUMMARY OF THE INVENTION

The device of the present invention fulfills a need for a unique electronic counter for numbers called in games such as bingo, keno or lotto. The device provides a portable or handheld housing with a screen for displaying frequency results, a series of number buttons corresponding to the numbers called in bingo or any other number game, lights arranged to indicate when each number button has been pushed, one or more storage buttons for storing an entire game of number buttons pushed, and a numerical calculator electrical operation circuit with a memory add circuit and storage registers corresponding to each storage button for adding and/or calculating the frequency with which each number button has been pushed over several games. Additionally, the device can include one or more recall storage buttons for displaying the values stored in a storage register and clear storage buttons resetting the values stored in a storage register to zero. The numbers called in a game can be recorded by depressing the number button corresponding to each number called. When a number button is pushed, a value of one becomes associated with that particular number button and a display light can be illuminated to let the user know that number button was pushed during that particular game. Then, after a series of number buttons have been pushed or at completion of a game, their associated values can be stored in a storage register of the numerical calculator electrical operation circuit by pressing a storage button. After adding and storing the values in a storage register the display lights are no longer illuminated and the values corresponding to each of the number buttons are reset to zero. Additional games can then be played and the number buttons that were pushed during the game can also be stored and their values added to the same storage register or a new storage register of the numerical calculator electrical operation circuit by pressing a storage button again. The storage register thus "counts" by adding a value of one every time a number is called over several games. When desired, the frequency with which each number was called (or the number of times each number button was pressed during several games) can be displayed on a screen by pressing a recall storage button. The recall storage button causes the values stored in a storage register to display on the screen, and the values are a count of how many times each number button was pushed during a series of games. Multiple storage buttons and storage registers can be included for storing games in different registers. For example, lotto games can be stored in one storage register and keno games in another, or Monday bingo games can be stored in one storage register and Tuesday bingo games can be stored in another. Finally, buttons can be included to clear a previous number button entry, all previous number button entries that have not yet been stored in a storage register, or an entire storage register.

BRIEF DESCRIPTION OF THE DRAWINGS

The advantages, features and operation of the invention will become apparent from a reading of the detailed description in connection with the accompanying drawing in which like reference numerals refer to like elements and in which.

DETAILED DESCRIPTION OF THE INVENTION

Figure 1:
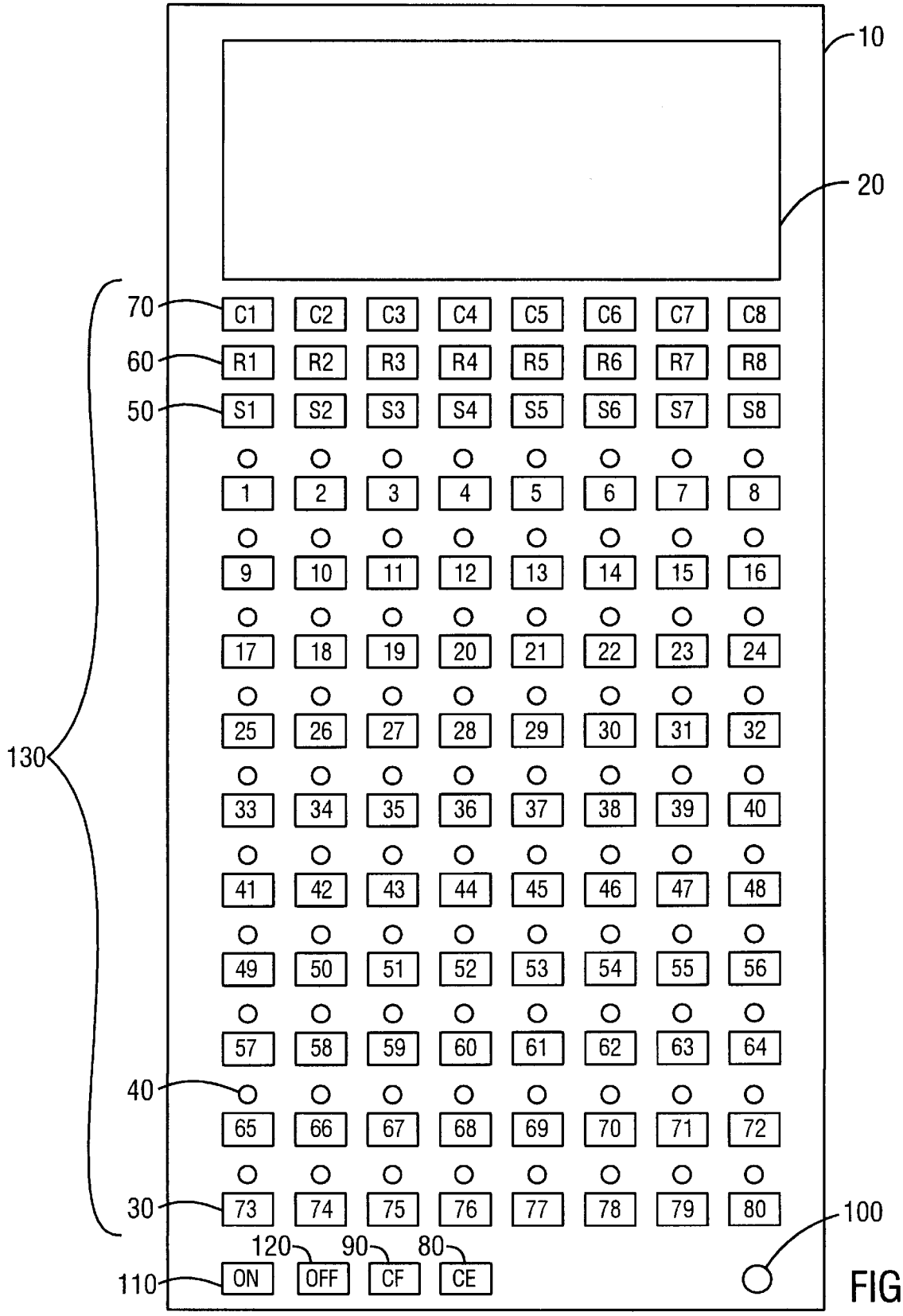
FIG. 1 is a top plan view of a number frequency counting device in accordance with the present invention.

In the following description and in the claims, various details will be identified by specific names for convenience, but they are intended to be generic in their application as the art permits. In the accompanying drawing and description forming part of this specification, certain specific disclosure of the invention is made for purposes of explanation, but it will be understood that the details may be modified in various respects without departure from the broad aspect of the invention.

Reference is made now to the accompanying drawing.

As illustrated in FIG. 1, the number frequency counting device has a housing 10 in which a numerical calculator electrical operation circuit with a memory add circuit and storage registers, such as a microprocessor, powered by a battery is mounted. In the center of the top surface of the housing 10, is a display screen 20. In a preferred embodiment, the display screen 20 has numbers 1 through 80 etched on it in ten rows of eight columns.

Beneath the display screen 20 on the top surface of the housing 10 there is a keypad 130. The keypad 130 contains number buttons 30 with numbers either formed thereon or in a manner such that a number is associated with each number button 30. The numbers correspond to the numbers that could be called in a game of bingo, keno, lotto or other number oriented game. Each of the number buttons 30 has a value associated with it which is recorded in the memory add circuit of the numerical calculator electrical operation circuit in a number button memory location. The default value is zero. The value after a number button 30 has been pushed is one. In a preferred embodiment, there are ten rows of eight columns of consecutive whole numbers from one through eighty.

In a preferred embodiment, above each of the number buttons 30 on the keypad 130 a visual display light 40 is located to indicate whether that particular number button 30 has been pushed during the current game the player is recording.

Also on the keypad, there are one or more storage buttons 50 that indicate storage registers of the numerical calculator electrical operation circuit. Each storage register contains a set of values wherein each value in the set corresponds to a number button 30. The default values are zero. When a set of pushed number buttons 30 is stored by pressing a storage button 50 and added to a storage register, each of the values associated with a number button 30 in the storage register is increased by one if the number button memory location contains the value one (which indicates that number button 30 already had been pushed). If the number button memory location contains the value zero, then the value in the storage register associated with that number button 30 remains the same. On the keypad, there are also one or more recall buttons 60 that recall the values stored in each storage register. In a preferred embodiment, there are also one or more clear storage buttons 70 that clear the values stored in each storage register. A preferred embodiment contains eight storage buttons 50, which have "S1" through "S8" formed thereon, eight recall buttons 60, which have "R1" through "R8" formed thereon, and eight clear buttons 70, which have "C1" through "C8" formed thereon. Multiple storage buttons allow a player to store different games in different places so that, for example, bingo games can be stored with one storage button and lotto games with another. In another embodiment, a similar effect can be obtained using a different numerical calculator electrical operation circuit by pushing one storage button "S" followed by a number button 30 corresponding to 1 or 2 and so on, i.e., S, 1 or S, 2.

Also on the keypad, in a preferred embodiment, there is a clear field button 90 for resetting the values associated with all of the number buttons 30 to zero and a clear entry button 80 for resetting the value associated with one number button 30 to zero. The clear entry button 80 can operate by automatically resetting the value associated with the last pushed number button 30 to zero or by resetting to zero the value associated with the number button 30 pushed immediately after pushing the clear entry button 80. The clear field button 90 resets all of the values to zero of all of the number buttons 30 that have not yet been stored by pressing a storage button 50. These buttons preferably have "clear entry", "clear field", "CE" or "CF" formed thereon.

Finally, on the top surface of the housing 10 in a preferred embodiment there is an "ON" button 110 and an "OFF" 120 button or an ON/OFF switch. There is also a low battery indicator 100.

The housing 10 has various suitable internal compartments and pedestals for containing the various components of the numerical calculator electrical operation circuit and for mounting the input keys of the keypad 130, the display screen 20 components and other components, as is well known in the art. In a preferred embodiment, the power supply for the device is provided by a battery, which may be a rechargeable battery, and which is mounted conventionally in a small compartment on the walls of which are conventional contacts for electrically connecting the battery to the numerical calculator electrical operation circuit and other electrically actuated components, such as the visual display lights 40. Convenient access to the battery is provided by an access door.

In a preferred embodiment, the number buttons 30, storage buttons 40, recall buttons 50, clear storage buttons 60, clear entry button 80, clear field button 90, and other buttons are disposed in conventional spring biased mountings inside the housing 10 and are connected so as to close electrical contacts to provide input pulses to the numerical calculator electrical operation circuit, as is well known in the art.

The numerical calculator electrical operation circuit can be a microprocessor or a type of chip which is preprogrammed to perform the usual memory, arithmetic, and control functions, with conventional input and output capabilities. It will be securely mounted in the housing 10 and have conventional electrical connections to the input and output devices and to the power supply. The numerical calculator electrical operation circuit should have a Read Only Memory for all of the operations set forth hereinafter, except for those relating to input to be performed by the operator of the device.

The display screen 20 is equipped with some means to provide an alphanumeric readout display. A Liquid Crystal Display (LCD) is shown and described for the display screen 20, but it is to be understood that other readout devices could be used, if appropriate. It will be understood by one skilled in the art that an appropriate number of readout devices, such as LCDs will be placed adjacent the top surface of the readout element to achieve the numbers or letters shown and described, and that the surface chosen for the window or display square will be transparent and translucent. It will be further understood that means well known in the art are provided for actuating the LCDs in accordance with the instructions provided by the numerical calculator electrical operation circuit.

In describing the operations herein, in order to explain the interaction of the mechanical input steps performed by the device's operator, the computational steps performed by the numerical calculator electrical operation circuit, and the visual correlation for the input by the player, and the enjoyment and facilitation of use, the operations of the numerical calculator electrical operation circuit are described in a rudimentary fashion so that such correlation may be seen. It will be obvious to one of ordinary skill in the art that a commercial embodiment of the device would condense and economize in carrying out the operations of the calculator. For example, where several operations are performed herein, the commercial embodiment might combine such several operations into one function. For example, a plurality of elements such as "storage registers", "memory locations", and so forth are described in order that the correlation between the input and visual output can be understood. It is the visual display which facilitates the accuracy of input to the numerical calculator electrical operation circuit, and which coacts with the input and the computations to provide the unique display, rather than the particular programs employed to make the correlation that is important.

Other aspects of the operation are basic, or implied, and are not mentioned herein because a person of ordinary skill in the art would understand them to be included. For example, when a number is stated to be stored or retrieved, means must exist to give it an address. Because this is inherent, such means is not necessarily specifically mentioned, but is implied.

Moreover, sometimes a simplicity of language may be used in a description. For example, when a reference is made to a number button 30 activating a routine, or being stored, it is an electrical impulse or energy (or the absence thereof) arranged in a precoded binary manner to be representative of such information that is being transmitted or stored, rather than the information itself, as is well known in the computer art.

In the description herein, reference is made to routines. The particular routine can be any program which is compatible with the manufacturer's particular chip and programming language preference, as is well known in the computer art, but which will carry out the operations to provide the calculations and visual displays herein. For example, a storage routine would be any routine which can store particular aspects of information in memory in a particular manner. The numerical calculator electrical operations circuit arrangement of computational and processing elements are merely illustrative to bring out the correlation between the manual input and visual output.

It is to be understood that where "storage register" or the like is used in the text, this is a reference to a particular field, or one of a series of such fields within a storage area, or array, or element of an array, rather than necessarily to a specific address in memory.

When a player is playing a game, the player upon hearing a number called, presses the number button 30 on the keypad 130 that corresponds to the number called. Pressing the number button 30 activates a number pressed routine, which stores a value of one in a number button memory location in the memory add circuit associated with that particular number button 30. The number pressed routine then causes the visual display light 40 above that particular number button 30 to be illuminated. A player repeats this for each number that is called during the game, and there is a number button memory location in the memory add circuit associated with each number button 30. The value of each number button memory location associated with a number button 30 will always be either zero or one.

Once all the numbers in a game have been called, a player can store or record which corresponding number buttons were pushed during the game by pressing a storage button 50. Pressing a storage button 50 activates a store and add routine. There are storage registers corresponding to each storage button 50 such that each storage register contains values corresponding to all of the number buttons 30. The default values on the storage registers are zero. The store and add routine causes the values in all of the number button memory locations to be added to the corresponding values in the register for the storage button 50 that was pressed. The store and add routine then resets the values of the number button memory locations to zero and causes all of the visual display lights 40 to cease to be illuminated. This can be repeated for subsequent games. Additionally, different games can be stored in different storage registers; for example, lotto games can be stored in one storage register and keno games in another, or Monday bingo games can be stored in one storage register and Tuesday bingo games in another. In a preferred embodiment, the values corresponding to the number buttons 30 in the storage registers cannot exceed 999. Also in a preferred embodiment, the storage registers are not erased when the power to the device is turned off.

After values have been added to a storage register with a storage button 50, a player may wish to view the values in the storage register. The player can press a recall storage button 60 which activates a recall storage routine. The recall storage routine causes the values of the storage register associated with one of the storage buttons 50 to be displayed on the display screen 20. In the preferred embodiment there is means to display each of the values on the screen in a pattern such that each value appears next to the number etched on the display screen 20 that corresponds to the number button 30 for which the value in the storage register has been added.

A player may also wish to reset the values in the storage registers to zero. To do so, the player presses a clear storage button 70, which activates a clear storage routine. The clear storage routine causes all of the values in the storage register associated with a storage button 50 to be reset to zero.

When inputting numbers called during a game, a player may make an error. In one embodiment, to clear a number entered, the player presses the clear entry button 80 followed by the number button 30 for which the player made an error. Pressing the clear entry button 80 activates a clear entry routine, which waits for the user to input a number button 30. After the user inputs the number button 30, the clear entry routine resets to zero the value in the number button memory location associated with the number button 30 pressed. Then the clear entry routine causes the visual display light 40 associated with that number button 30 to cease to be illuminated. In another embodiment, to clear the most recent number entered, the player presses the clear entry button 70, which activates a clear entry routine. The clear entry routine causes the number button memory location associated with the most recent number button 30 pressed to be reset to zero. The clear entry routine then causes the visual display light 40 associated with that number button to cease to be illuminated.

Finally, a player may wish to clear an entire game or field of numbers entered with the number buttons without storing them in a storage register. To do so, the player presses the clear field button, which activates the clear field routine. The clear field routine resets all of the number button memory locations to zero and causes all of the visual display lights 40 to cease to be illuminated.

What is claimed is:

1. A number frequency counting device comprising a housing means;

a numerical calculator electrical operation circuit contained within the housing means, the numerical calculator electrical operation circuit comprising at least a memory add circuit with storage registers having default values of zero;

an alphanumeric display readout positioned in the housing means and electrically connected to the numerical calculator electrical operation circuit;

a keyboard positioned on the housing means;

a plurality of first buttons positioned on the keyboard and having numbers associated therewith, each first button having an associated default value of zero in the memory add circuit and being electrically connected to the numerical calculator electrical operation circuit to record which of each of the first buttons is pushed and set the corresponding value to one in the memory add circuit;

a plurality of display lights positioned on the keyboard, each display light corresponding to a first button and being electrically connected to the numerical calculator electrical operation circuit to illuminate when the corresponding first button is pushed;

a second button positioned on the keyboard and electrically connected to the numerical calculator electrical operation circuit to add and record the values in the memory add circuit associated with the plurality of number buttons to a storage register;

a third button positioned on the keyboard and electrically connected to the numerical calculator electrical operation circuit to display the values in a storage register on the alphanumeric display.

2. The number frequency counting device of claim 1 further comprising a fourth button positioned on the keyboard and electrically connected to the numerical calculator electrical operation circuit to set values in a storage register to zero.

3. The number frequency counting device of claim 1 further comprising a fourth button positioned on the keyboard and electrically connected to the numerical calculator electrical operation circuit to set the value in the memory add circuit associated with a first button to zero and to cause the adjacent display light to cease to be illuminated.

4. The number frequency counting device of claim 3 wherein the fourth button has indicia indicating "clear entry" associated therewith.

5. The number frequency counting device of claim 1 further comprising a fourth button positioned on the keyboard and electrically connected to the numerical calculator electrical operation circuit to set all of the first button values in the memory add circuit to zero and to cause all of the corresponding display lights to cease to be illuminated.

6. The number frequency counting device of claim 5 wherein the sixth button has indicia indicating "clear field" associated therewith.

7. A number frequency counting device comprising a housing means;

a numerical calculator electrical operation circuit contained within the housing means, the numerical calculator electrical operation circuit comprising at least a memory add circuit with storage registers having a default value of zero;

an alphanumeric display readout positioned in the housing means;

a keyboard positioned on the housing means;

a plurality of first buttons positioned on the keyboard and having numbers associated therewith, each first button having an associated default value of zero in the memory add circuit and being electrically connected to the numerical calculator electrical operation circuit to record which of each of the first buttons is pushed and to set the corresponding value to one in the memory add circuit;

a plurality of display lights positioned on the keyboard, each display light corresponding to a first button and being electrically connected to the numerical calculator electrical operation circuit to illuminate when the corresponding first button is pushed;

one or more second buttons positioned on the keyboard and electrically connected to the numerical calculator electrical operation circuit to add and record the values in the memory add circuit associated with the plurality of number buttons to a storage register;

one or more third buttons positioned on the keyboard and electrically connected to the numerical electrical operation circuit to display the values in a storage register on the alphanumeric display;

one or more fourth buttons positioned on the keyboard and electrically connected to the numerical electrical operation circuit to set values in a storage register to zero;

a fifth button positioned on the keyboard and electrically connected to the numerical calculator electrical operation circuit to set the value in the memory add circuit associated with a first button to zero and to cause the adjacent display light to cease to be illuminated;

a sixth button positioned on the keyboard and electrically connected to the numerical calculator electrical operation circuit to set all of the first button values in the memory add circuit to zero and to cause all of the corresponding display lights to cease to be illuminated.

8. A number frequency counting device comprising a housing means;

a numerical calculator electrical operation circuit contained within the housing means, the numerical calculator electrical operation circuit comprising at least a memory add circuit with storage registers having a default values of zero;

an alphanumeric display readout positioned in the housing means and electrically connected to the numerical calculator electrical operation circuit;

a keyboard positioned on the housing means;

a plurality of first buttons positioned on the keyboard and having numbers associated therewith, each first button having an associated default value of zero in the memory add circuit and being electrically connected to the numerical calculator electrical operation circuit to record which of each of the first buttons is pushed and set the corresponding value to one in the memory add circuit;

a plurality of display lights positioned on the keyboard each display light corresponding to a first button and being electrically connected to the numerical calculator electrical operation circuit to illuminate when the corresponding first button is pushed;

a plurality of second buttons positioned on the keyboard and electrically connected to the numerical calculator electrical operation circuit to add and record the values in the memory add circuit associated with the plurality of number buttons to a storage register;

a plurality of third buttons positioned on the keyboard and electrically connected to the numerical calculator electrical operation circuit to display the values in a storage register on the alphanumeric display.

9. The number frequency counting device of claim 8 further comprising a one or more fourth buttons positioned on the keyboard and electrically connected to the numerical calculator electrical operation circuit to set values in a storage register to zero.

10. The number frequency counting device of claim 8 further comprising a fourth button positioned on the keyboard and electrically connected to the numerical calculator electrical operation circuit to set the values in the memory add circuit associated with a first button to zero and to cause the corresponding display light to cease to be illuminated.

11. The number frequency counting device of claim 9 wherein the fourth button has indicia indicating "clear entry" associated therewith.

12. The number frequency counting device of claim 8 further comprising a fourth button positioned on the keyboard and electrically connected to the numerical calculator electrical operation circuit to set all of the first button values in the memory add circuit to zero and to cause all of the corresponding display lights to cease to be illuminated.

13. The number frequency counting device of claim 12 wherein the fourth button has indicia indicating "clear field" formed thereon.

* * * * *